United States Patent [19]

Nye

[11] 4,333,252

[45] Jun. 8, 1982

[54] METHOD FOR PLEATING CLOTH

[75] Inventor: LaVonne Nye, Coal Valley, Ill.

[73] Assignee: B&B Miniatures, The Whimsey, Coal Valley, Ill.

[21] Appl. No.: 266,568

[22] Filed: May 22, 1981

Related U.S. Application Data

[60] Division of Ser. No. 40,263, May 18, 1979, Pat. No. 4,284,215, which is a continuation of Ser. No. 871,916, Jan. 24, 1978, abandoned.

[51] Int. Cl.[3] ..... D06F 67/04; A41H 43/00

[52] U.S. Cl. ..... 38/144; 223/33

[58] Field of Search ..... 223/28, 33, 38; D15/66, D15/78; 28/167; 38/144

[56] References Cited

U.S. PATENT DOCUMENTS

| | | | |
|---|---|---|---|
| 1,210,346 | 12/1916 | Mitchell | 223/33 |
| 1,217,874 | 2/1917 | Matthews et al. | 223/33 |
| 2,863,592 | 12/1958 | Terry | 223/33 |
| 3,559,317 | 2/1971 | Knight et al. | 38/144 |
| 3,568,343 | 3/1971 | DeLoach | 38/144 |
| 3,823,452 | 7/1974 | Harrow | 28/167 |
| 4,198,202 | 4/1980 | Kleber | 223/33 X |

FOREIGN PATENT DOCUMENTS

| | | | |
|---|---|---|---|
| 451047 | 10/1927 | Fed. Rep. of Germany | 223/33 |
| 1447 | of 1895 | United Kingdom | 223/33 |
| 283779 | 1/1928 | United Kingdom | 223/33 |

*Primary Examiner*—Louis Rimrodt

*Attorney, Agent, or Firm*—Millen & White

[57] ABSTRACT

An apparatus for pleating cloth especially to make miniaturized drapes comprising a rectangular frame having a number of flexible rectangular slats movable along the length of the frame. In the preferred embodiment, the slats are placed on wire guides at two opposite ends of the frame and are movable on the guides, and in the alternative embodiment the T-shaped ends of the slats are placed within a U-shaped tunnel running along the length of the frame.

The fabric to be pleated is interwoven between the slats, the slats are compressed to one side of the frame, and steam is applied to the fabric supported by the frame. Steam may be applied to the opposite side of the frame with fabric thereon, the fabric is allowed to dry, and it is subsequently removed from the frame, adjusted to a desired shape, steamed and allowed to dry, thereby retaining its pleated shape.

1 Claim, 5 Drawing Figures

METHOD FOR PLEATING CLOTH

This is a division, of application Ser. No. 40,263 filed May 18, 1979, now U.S. Pat. No. 4,284,215, Aug. 18, 1981 which is a continuation of now abandoned application Ser. No. 871,916 filed Jan. 24, 1978.

BACKGROUND OF THE INVENTION

The applicant is also the inventor of a cloth pleater claimed in U.S. Pat. No. Des. 256,586 entitled "CLOTH PLEATER".

This invention relates generally to an apparatus for pleating cloth or articles made therefrom, such as draperies, and a method of use of the apparatus in pleating of the cloth.

More particularly, this invention relates to an apparatus used in pleating of a fabric material which has considerable inherent flexibility, thereby allowing the fabric to be easily interwoven between a series of parallel pleating slats engaged by guide means on two end members of the pleater.

Different embodiments of apparatus for pleating plain cloth and finished articles of clothing for human consumption, such as skirts and curtains, are well known in the art and have been used for many years. Various cloth pleaters known in the prior art differ from each other in their construction and method of use, but generally speaking such devices comprise a number of parallel slats mounted on a frame. The cloth is usually placed between two adjacent slats thereby imparting a desired crease to the fabric. The slats may or may not be movable in relation to each other and in relation to the frame on which they are mounted. However, it appears from the prior art that it is preferable to have at least some of the slats movable along the length of the frame. The prior art, due to relatively heavy fabric used for pleating, is often constructed to have some of the slats movable upwardly from the plane of the frame. It is also known in the art to use crimping strips instead of movable or stationary pleating slats for pleating of the fabric. Exemplary of prior art pleaters using parallel slats is Terry, U.S. Pat. No. 2,863,592, wherein the pleaters are mounted on a U-shaped frame and are spaced along the width of the frame. The slats are restrained from the movement along the frame by spacing collars placed between adjacent slats at one end thereof. The cloth is pleated by inserting a wet, double-folded thickness of the fabric between the adjacent slats and allowing the fabric to dry before it is removed from the pleater. Matthews et al., U.S. Pat. No. 1,217,874 and Eder, U.S. Pat. No. 669,743, also relate to fabric pleaters having a number of parallel slats which are used for pleating the fabric. However, in both references at least one half of the slats are pivoted at only one end thereof to the guide rod on the frame, thereby allowing the other end of such pivotally-attached slat to be raised from the plane of the pleater. The fabric is interwoven between the alternating slats and it appears that the provision of the pleater with some of the slats movable in a direction perpendicular to the plane of the pleater is necessary for facilitating pleating of the relatively thick and inflexible material for which the pleaters disclosed therein are used. Steam is applied to the pleated fabric in Eder, however, Matthews et al. do not disclose the application of steam or heat to the pleated fabric. Lehmann, U.S. Pat. No. 437,212, Clark et al., U.S. Pat. No. 1,410,453, and Castleman, U.S. Pat. No. 664,721 all relate to fabric pleating apparatus wherein continuous crimping strips are substituted for parallel pleating slats of the above-discussed prior art.

It is seen therefore that although the prior art is replete with examples of devices and methods for pleating fabrics, most of such devices are relatively cumbersome in operation and are concerned with pleating of relatively heavy and thick material used for the making of window curtains and pleated skirts. The design of the prior art apparatus reflects this utility by providing the pleaters with relatively movable pleating slats or crimping strips. Where parallel pleating slats are used in the prior art pleaters, the slats are restrained from free movement along the width of the pleater at one end of the slat. Alternatively, the slats are free to move along the guiding means of the pleater, but at least some of these slats are pivoted at one end thereof to the guiding means, therefore allowing the opposite end of the slat to be movable in a direction perpendicular to the plane of the pleater. Provision of the pivoted slats appears to compensate for the relatively inflexible fabrics used with the apparatus of the prior art.

OBJECTS OF THE INVENTION

It is a principal object of this invention to provide a cloth pleater for making miniaturized drapes comprising a frame having two side members and two end members, a guiding means placed within each of said side members and a series of flat parallel pleating slats freely movable along said side members, with each end of every slat being trapped by the guiding means.

It is another object of this invention to provide a cloth-pleating apparatus wherein said guiding means may comprise either a laterally extending guiding rod engaging an opening in each end of every pleating slat, or a laterally extending channel for receiving appropriately shaped ends of the pleating slats which are shaped to complement the shape of the guiding channel.

It is yet another object of this invention to provide a process for pleating cloth, using the apparatus of this invention, wherein the pleated cloth is repeatedly contacted with steam and allowed to dry after each application of the steam, thereby permanently preserving pleats imparted to the cloth by the apparatus of this invention.

BRIEF DESCRIPTION OF THE INVENTION

In accordance with this invention, there is provided an apparatus for pleating minaturized draperies and the like fabric articles for small furniture, comprising a frame covering an area of about 1 square foot, said frame, having two side members and two end members connected to the side members, in a nondetachable manner and in a fixed relationship, each of said side members having a U-shaped channel comprising a rectangular base and two walls opposite to each other extending perpendicular from said base member, each of said channels facing the U-shaped channel in the opposite side member, a separate guide means in each of said side members extending substantially the length of said side members, each of said guide means supported individually by said U-shaped channel in each of the respective side members and a series of flat parallel flexible pleating slats with each end of every slat being trapped for free rectilinear movement along said guide means. In the preferred embodiment of the invention, the guiding means comprises guiding rods recessed within the side members of the frame and each slat contains an opening at each end thereof which is engaged by the guiding rods of this embodiment. The guiding rods are slightly flexible and the opening in the slats are longer than the diameter of the guiding rods to allow for permissive flexing of the slats in operation of the pleater.

In the alternative embodiment, the guiding means comprises a partially enclosed channel extending the length of the side members of the frame and the ends of each of the pleating slats are appropriately shaped for engagement by the channel to allow relatively free movement of the slats along the length of the channel. The shape of the slats of this embodiment also allows for a permissive flexing and movement of the slats.

DETAILED DESCRIPTION OF THE INVENTION

The invention described hereinafter, due to its construction and features which will be specifically pointed out in the following description, is peculiarly adapted for making draperies for miniature houses, such as doll houses and other pleated fabric articles for small furniture, from fabric material having considerable inherent flexibility. However, the utility of this invention is not limited to the above described applications and it will be apparent to those skilled in the art that the apparatus of this invention is quite flexible and can be used for a variety of diverse applications.

Figure 1:
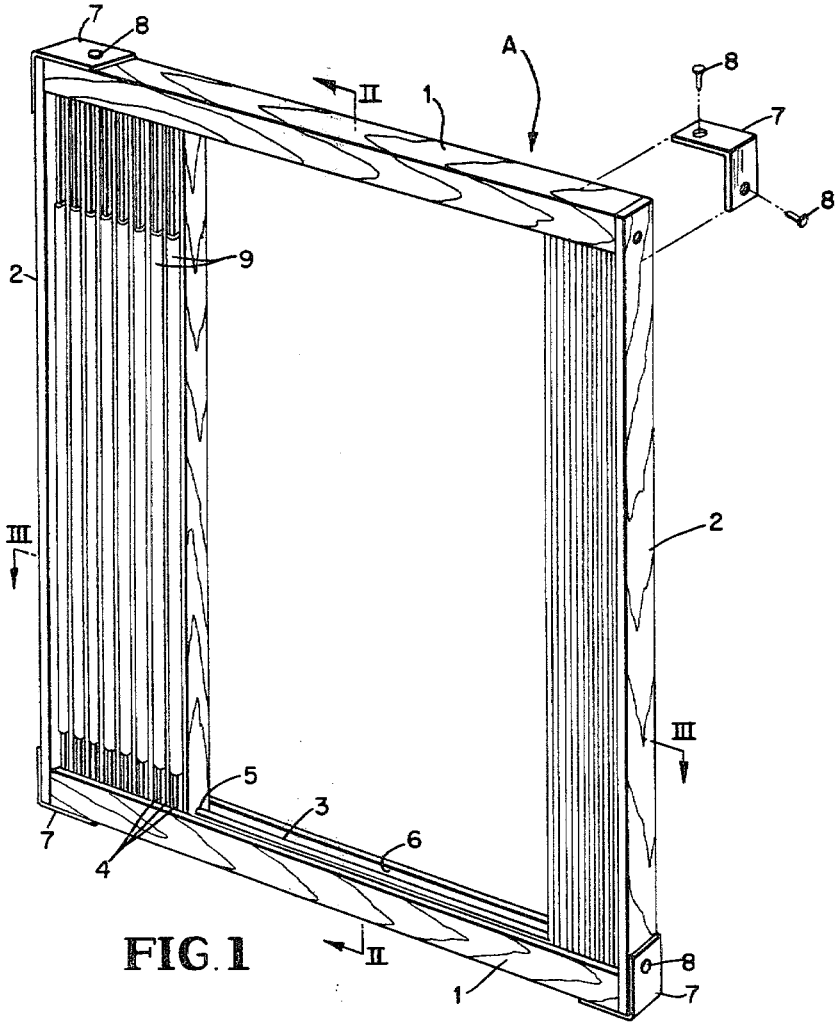
FIG. 1 is a perspective view of the preferred embodiment of this invention.

With reference to FIG. 1, the pleater A comprises a pair of identical parallel side members 1 and a pair of parallel end members 2, connected to the side members by right-angled corner brackets 7 and tacks 8, or similar fasteners as known in the art. Each of the side members 1, has a U-shaped channel 6, respectively, (FIG. 2) formed in the bottom thereof which faces the other side member. Two guide rods 3, which are disposed within the channels are fastened to the end members 2 at the ends thereof. The pleater has a number of flexible parallel slats 4 and every slat has a closed periphery opening 5 at each end thereof. The openings are engaged by the guide rods 3, and every slat is freely movable along the length of the side members 1. The guide rods and the slats are slightly flexible and the openings in the slats are elongated to allow for permissive flexing and movement of the slats in the operation of the pleater. The frame and the slats can be made of a thin plywood or wood, or any other suitable material, and it is preferred that each frame contain about 30 slats.

Figure 3:
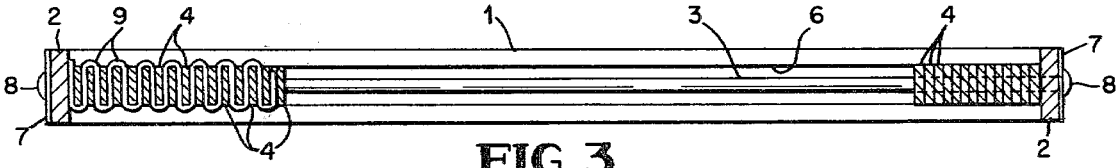
FIG. 3 is a slightly enlarged cross-section taken along the line III—III of FIG. 1.
Figure 4:
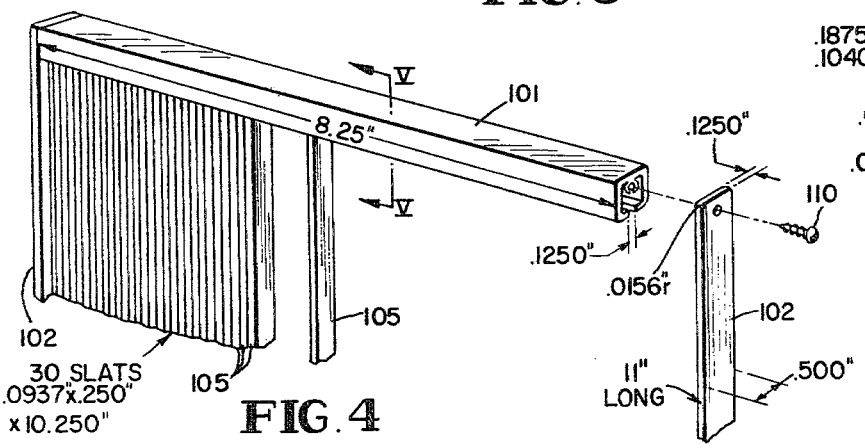
FIG. 4 is a fragmentary perspective view of an alternative embodiment of this invention; and, FIG. 5 is a slightly enlarged cross-section taken along the line V—V of FIG. 4.
Figure 5:
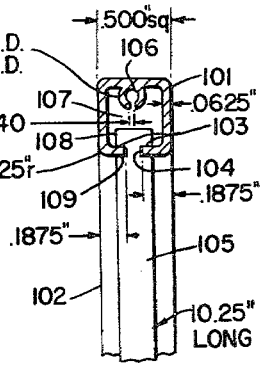

An alternative embodiment of the invention (FIGS. 4 and 5) also comprises a frame, similar in shape and construction to the frame of the preferred embodiment, with two end members 102 and two side members 101. Although only one side member 101 is shown in FIG. 4, both of these members are identical in construction and shape—similarly to the side members 1 of FIG. 1—and therefore the construction of the pleater will be readily apparent from the showing of FIG. 4 to one of ordinary skill in the art. However, the side members 101, as seen in a cross-section of FIG. 5, have a shape of a partially enclosed channel 107. The bottom of the channel is partially enclosed by two flanges 103 which leave an opening 104 therebetween. The upper wall of the channel, opposite from the opening 104, has a receptacle formation 106 to receive a screw or other fastener. This embodiment also contains a number of slats 106. However, the slats, instead of having an opening at each end thereof as in the embodiment of FIGS. 1-3, have a T-shaped head 108. The head 108 is attached to the body of the slat 105 through a narrow portion leaving two symmetrically placed notches 109. The notches are so dimensioned as to receive the flanges 103 with some play for permissive flexing of the slats and to allow for a free sliding motion of the slats along the length of the channel 107. The slats are preferably made from a single piece of material, such as aluminum, with the notches and the T-shaped head cut from the metal blank in a manner well known in the art. The side members 101 and the end members 102 are also preferably made from aluminum with the side members 101 being extruded and the end members 102 being cut to a desired size and shape. Metal screw 110 is used to attach the end members 102 to the side members 101, with the receptacle 106 receiving the screw, which may be of the thread cutting type, and providing requisite support for tightening of all four members of the pleater.

Figure 2:
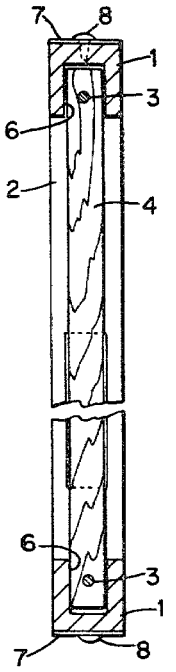
FIG. 2 is a slightly enlarged cross-section taken along the line II—II of FIG. 1.

The operation of the apparatus of this invention now will be described in relation to the preferred embodiment of the FIGS. 1-3. A fabric 9 (FIG. 3) is introduced between the end member 2 and the slat adjacent thereto. The slat is then pushed forward to hold the end of the fabric between the slat and the end member, and subsequently the fabric is bent over the slat and passed upwardly. The next slat is then advanced and pushed against the preceding slat, thereby pushing the first pleat and the fabric towards the end member 2. The fabric is bent over this slat and advanced into the plane of the pleater, the following slat is advanced and pushed against the preceding slats. This process is continued until the entire length of the fabric is interwoven between the slats on the frame (FIG. 3), following which the frame, along with the pleated fabric is placed on a suitable support board (not shown). The frame is pinned to the board and the drapery on the frame is steamed with an iron or other available source of steam. After steaming on one side, the frame is turned over and the opposite side of the pleated drape is also steamed and allowed to dry for about 15-20 minutes. The finished drapery is then removed from the pleater, molded to a desired shape by pushing pleats together and the drapery is again pinned to the support board. The drapery is steamed again and allowed to dry. After removal of the pins, the pleated fabric retains its size and shape and it is ready to be used. When using the alternative embodiment of FIGS. 4 and 5 the operation of the apparatus is essentially the same as that described for the embodiment of FIGS. 1-3 and it will be readily apparent to those skilled in the art from the above description.

Variations in the construction and method of operation of the cloth pleater described herein will readily occur to those skilled in the art without departing from the scope and spirit of the invention. Therefore, the invention is not limited to the particular embodiments described herein except as defined by the following claims.

What is claimed is:

1. A method of pleating cloth on a cloth pleater comprising a frame of two side members and two end members and having a series of flat pleating slats, with every slat being engaged by and freely movable along guide means associated with the side members and comprising the steps of:

interweaving the cloth between a number of pairs of slats, each pair defined by a preceding and a succeeding slat in said series;

continuously advancing said succeeding slat to said preceding slat until substantially the entire length of the cloth has been interwoven;

attaching the pleater with the cloth thereon to a rigid supporting surface;

applying steam to one surface of the cloth;

applying steam to the opposite surface of the cloth;

allowing the cloth to dry on the pleater;

removing the cloth from the pleater;

fastening the cloth to said supporting surface;

applying steam to the cloth and allowing the cloth to dry on said surface.

* * * * *